US008311453B2

(12) United States Patent
Imai

(10) Patent No.: US 8,311,453 B2
(45) Date of Patent: Nov. 13, 2012

(54) IMAGE FORMING APPARATUS

(75) Inventor: Yuichiro Imai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 12/823,563

(22) Filed: Jun. 25, 2010

(65) Prior Publication Data

US 2011/0033202 A1 Feb. 10, 2011

(30) Foreign Application Priority Data

Aug. 7, 2009 (JP) ..... 2009-185132

(51) Int. Cl.
*G03G 15/08* (2006.01)
*G03G 21/16* (2006.01)
*G03G 15/02* (2006.01)

(52) U.S. Cl. ..... 399/121; 399/111; 399/116

(58) Field of Classification Search ..... 399/110, 399/111, 116, 117, 121
See application file for complete search history.

(56) References Cited

U.S. PATENT DOCUMENTS

| | | | | |
|---|---|---|---|---|
| 6,453,136 | B1 | 9/2002 | Yasumaru | |
| 2005/0084290 | A1 * | 4/2005 | Baek et al. | 399/121 |
| 2008/0253804 | A1 * | 10/2008 | Furuta et al. | 399/119 |
| 2008/0310882 | A1 * | 12/2008 | Kato et al. | 399/114 |

FOREIGN PATENT DOCUMENTS

| | | | |
|---|---|---|---|
| JP | 10-3215 | A | 1/1998 |
| JP | 11-73035 | A | 3/1999 |
| JP | 2001-222207 | A | 8/2001 |

* cited by examiner

*Primary Examiner* — Joseph S Wong
(74) *Attorney, Agent, or Firm* — Fitzpatrick, Cella, Harper & Scinto

(57) ABSTRACT

An image forming apparatus includes a housing; a photosensitive member unit detachably mountable relative to the housing and which includes a photosensitive member; a transfer belt unit detachably mountable relative to the housing which includes a transfer belt member and a spacing mechanism for spacing the transfer belt member from the photosensitive member; a shaft member, provided in the housing, for supporting the photosensitive member; a guiding portion, provided on the photosensitive member unit, for guiding mounting, to the housing, of the photosensitive member unit; and a rotation regulating member, provided on the transfer belt unit, for regulating a movement of the guiding portion, in the a rotational direction, of the photosensitive member at the time of the mounting of the photosensitive unit to the housing.

10 Claims, 10 Drawing Sheets

IMAGE FORMING APPARATUS

FIELD OF THE INVENTION AND RELATED ART

The present invention relates to an image forming apparatus, wherein a photosensitive member unit and a transfer belt unit is detachably mountable individually relative to a housing, as respective units more particularly, to a structure for regulating an attitude at the time of the photosensitive member unit being mounted and demounted.

An image forming apparatus is used widely in which a toner image formed on a photosensitive member is transferred onto the recording material carried on an intermediary transfer belt or a recording material transportation belt. In such an image forming apparatus, normally, a transfer belt member (intermediary transfer belt or recording material transportation belt) is assembled into the transfer belt unit as an exchangeable unit, and the photosensitive member is assembled into a photosensitive member unit as an exchangeable unit.

Japanese Laid-open Patent Application 2001-222207 discloses an image forming apparatus in which a plurality of photosensitive member units are exchangeably disposed along a transfer belt member. Here, the photosensitive member units are supported by slide guides in the respective side, and the photosensitive member units are drawn individually along the rotation axes of the photosensitive members. It includes a door unit (FIG. 6) which is provided with a bearing mechanism for supporting an end of the shaft of the photosensitive member, wherein the openable and closable door unit tilts to a front side of the housing, and is opened, by which the photosensitive member unit is capable of being pulled out to the front side.

Japanese Laid-open Patent Application Hei 10-003215 discloses an image forming apparatus, wherein it is capable of being pulled out in the longitudinal direction in the state that the photosensitive member unit is hung from the housing down. Here, the pair of grooves for hanging is formed in top side surfaces of the photosensitive member unit, and in a housing side of the image forming apparatus, the rail members which are restrained by the groove and which guide the photosensitive member unit in the longitudinal direction are provided.

Japanese Laid-open Patent Application Hei 11-73035 discloses an image forming apparatus, wherein the transfer belt unit is capable of being pulled out horizontally from the housing in the direction perpendicular to a rotational direction along a surface of a transfer belt member. Here, as shown in FIG. 4, the transfer belt unit (30) is held detachably mountable on a frame (36) supported in the left and right portions thereof by the slide guide (35), and after the frame (36) is drawn to the front side, the transfer belt unit (30) is taken out upwardly from the frame (36). as shown in FIG. 1, the transfer rollers (5K) for press-contacting the transfer belt member (31) to the photosensitive members (1K) lower prior to the drawing operation of the frame, by which the transfer belt member (31) spaces from the photosensitive member (1K).

In the case of the photosensitive member units disclosed in the Japanese Laid-open Patent Application 2001-222207 and Japanese Laid-open Patent Application Hei 10-003215, the rotation axis of the photosensitive drum is connected with a coupling provided in the housing side, and therefore, a whirling and an eccentric rotation of the rotation axis of the photosensitive drum may occur. When the whirling and the eccentric rotation of the rotation axis of the photosensitive drum occur, a peripheral speed of the photosensitive drum varies to cause the strain and color deviation of the image.

In view of this, as shown in FIG. 1, a mounting structure for the photosensitive member unit in which a shaft member 55 for penetrating and rotationally driving the photosensitive drum (1K) is provided in the housing side, and a through-holes (57, 58) at the center of the photosensitive drum (1K) engages with the shaft member (55), is proposed.

In this case, when the mechanism which guides the photosensitive member unit in the axial direction is provided in the housing side, as disclosed in Japanese Laid-open Patent Application 2001-222207 and Japanese Laid-open Patent Application Hei 10-003215, a bending load is imparted to the shaft member, and an inserting direction tilts to increase a friction between the shaft member and the photosensitive drum. For this reason, it would be considered that positioning members are provided on the upper surface of the opened openable and closable door unit disclosed in Japanese Laid-open Patent Application 2001-222207, and the center of the photosensitive drum is positioned by the shaft member, wherein in an inserting process, it is guided only by the shaft member to confine the photosensitive member unit.

However, in this case, when the photosensitive member unit inclines slightly, in an initial stage of the insertion, it is difficult that the through-hole of the photosensitive drum is straightly inserted relative to the shaft member. At the instance when a trailing end of the photosensitive member unit finishes passing the positioning member, it is possible that the photosensitive member unit rotates about the shaft member. Particularly, in the case of a large-sized and heavy photosensitive member unit (10) as shown in FIG. 1, it is difficult that a rotation is prohibited in the front side of the openable and closable door unit, and therefore, it is possible that photosensitive member unit (10) contacts to the intermediary transfer belt (31).

When photosensitive member unit (10) always rubs with a portion of the housing side other than the shaft member (55), when photosensitive member unit (10) inclines, the large frictional force is produced with the result that an insertion resistance is large, and therefore it is possible that photosensitive member unit (10) is pushed in by a strong force.

SUMMARY OF THE INVENTION

An object of the present invention is to provide an image forming apparatus, wherein a photosensitive member unit rotates in an inserting process to suppress the contact to a transfer belt member.

According to an aspect of the present invention and there is provided an image forming apparatus comprising a housing; a photosensitive member unit detachably mountable relative to said housing and which includes a photosensitive member; a transfer belt unit detachably mountable relative to said housing which includes a transfer belt member and a spacing mechanism for spacing said transfer belt member from said photosensitive member; a shaft member, provided in said housing, for supporting said photosensitive member; a guiding portion, provided on said photosensitive member unit, for guiding mounting, to said housing, of said photosensitive member unit; a rotation regulating member, provided on said transfer belt unit, for regulating a movement of said guiding portion, in the a rotational direction, of said photosensitive member at the time of the mounting of said photosensitive unit to said housing.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENT

In the following, an embodiment of the present invention will be described in detail referring to a drawing.

The present invention is not limited to the image forming apparatus which employs an intermediary transfer belt, but it can be implemented also in the image forming apparatus in which a toner image is transferred onto the recording material carried on a recording material transportation belt. The present invention is not limited to a tandem type in which a plurality of photosensitive drums of are arranged along a belt member but it is applied also to the drum type 1 which employs only one photosensitive drum. In the tandem type, the present invention is not limited to a black color image forming station but it is applied also to a yellow, magenta, or cyan image forming station.

In the description of this embodiment, only the main parts relating to the formation and the transferring of the toner image will be described, but the present invention is applied to various usages such as the printers, the copying machines, facsimile machines, the composite machines by adding the required equipments, means, casing structures.

<Image Forming Apparatus>

Figure 1:
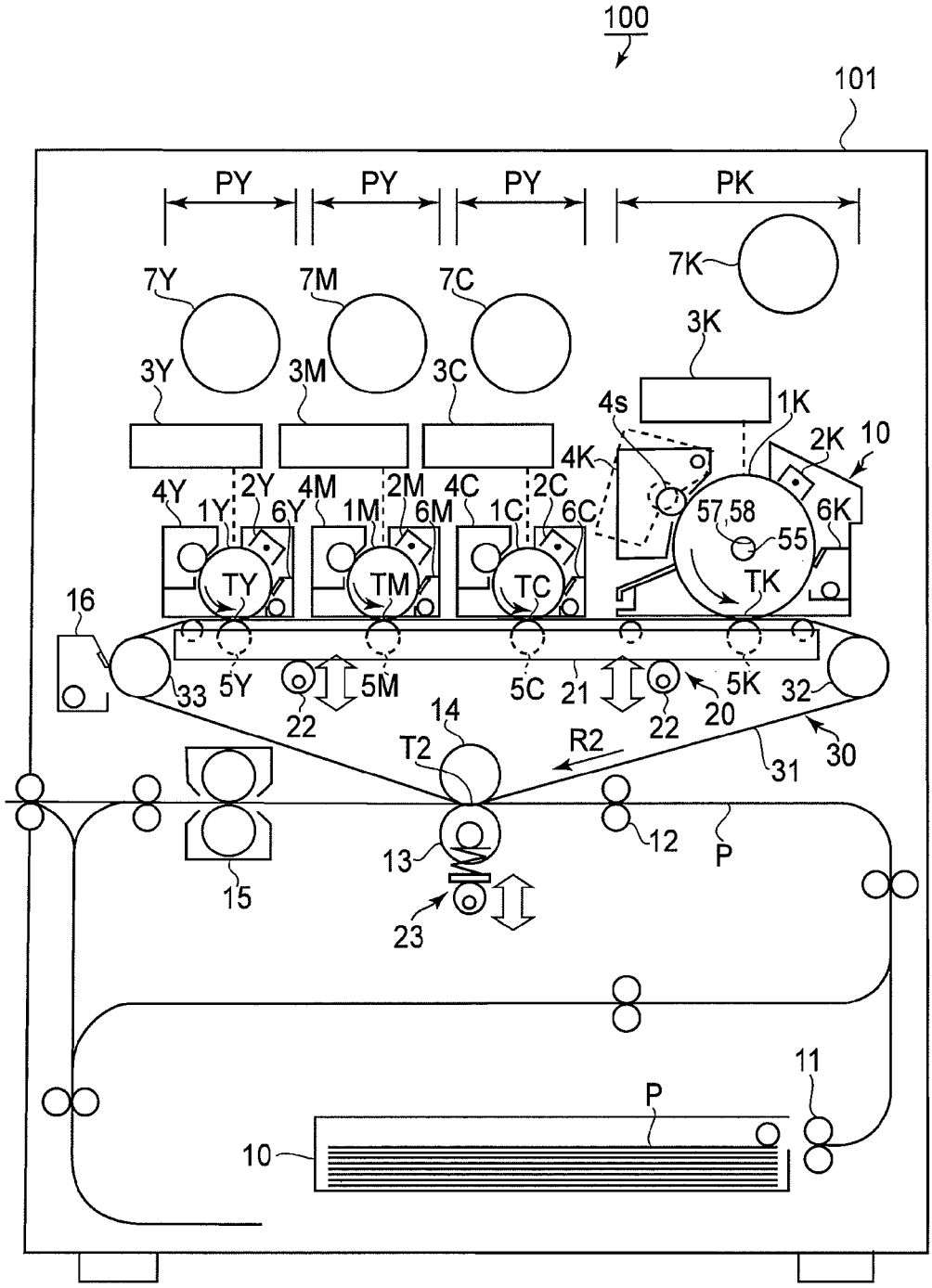
FIG. 1 is an illustration of structures of an image forming apparatus.
Figure 2:
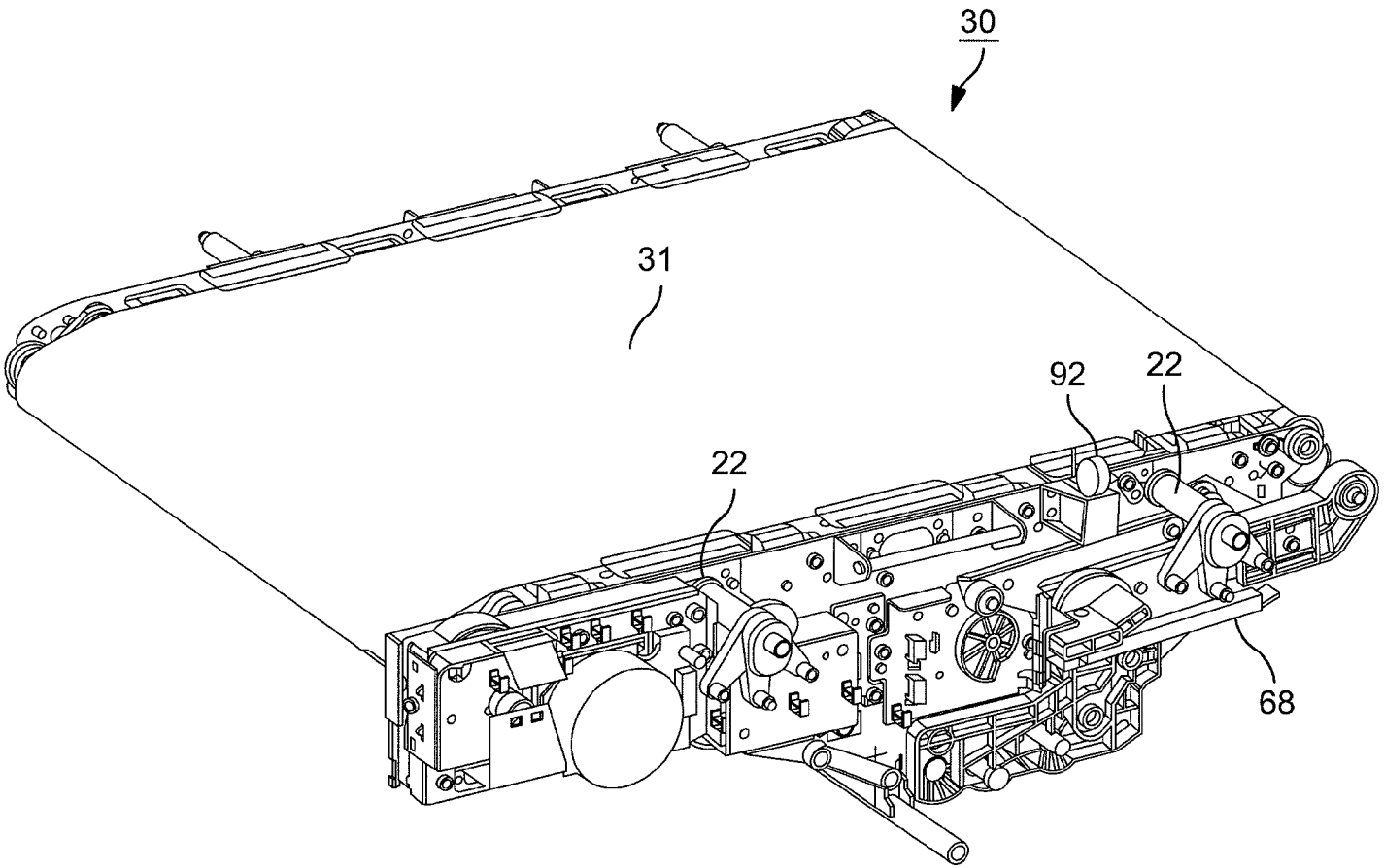
FIG. 2 is a perspective view of an intermediary transfer unit.
Figure 3:
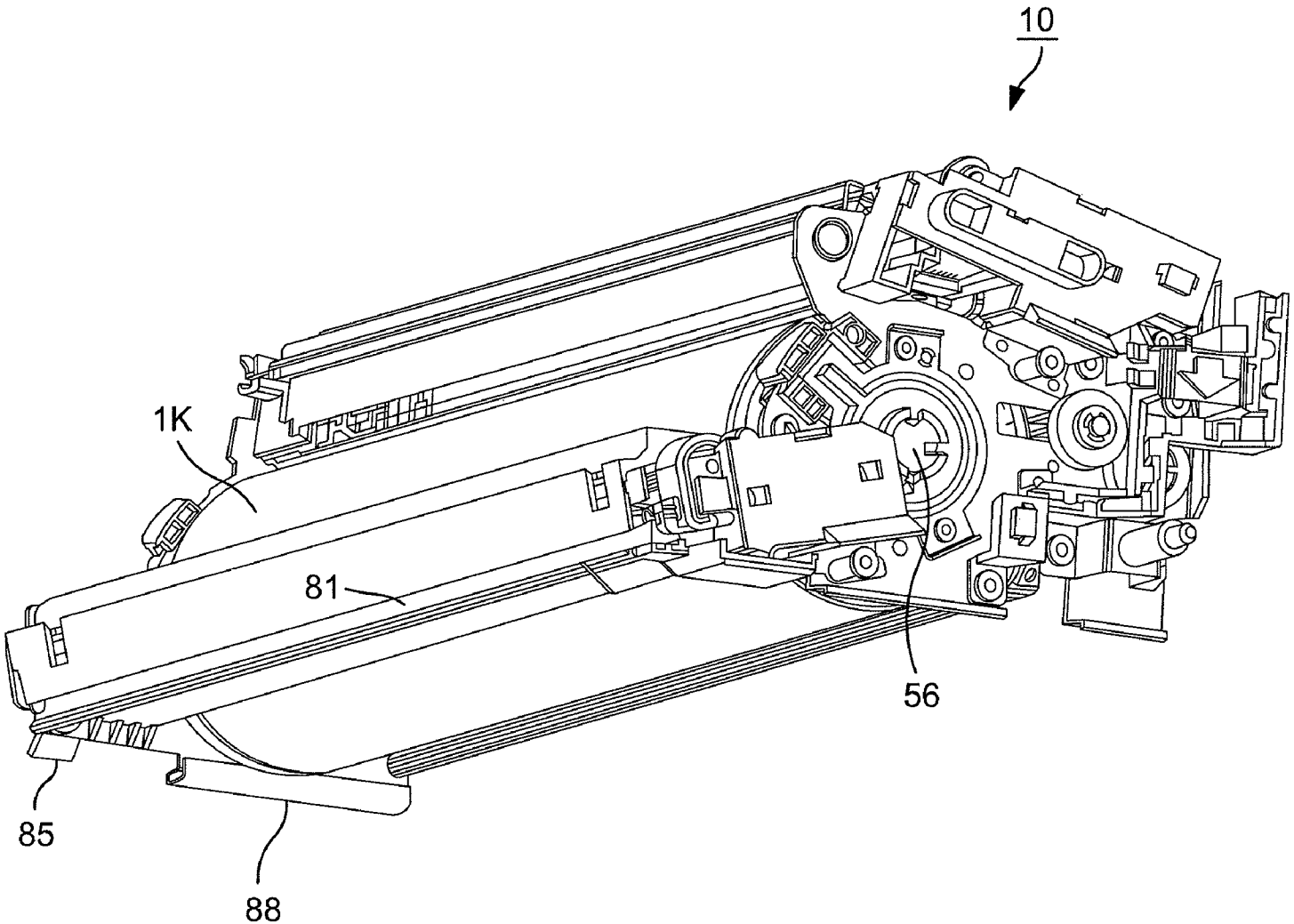
FIG. 3 is a perspective view of a process cartridge.

FIG. 1 is an illustration of the structures of the image forming apparatus. FIG. 2 is a perspective view of the intermediary transfer unit. FIG. 3 is a perspective view of the process cartridge.

As shown in FIG. 1, an image forming apparatus 100 of the embodiment is a full-color printer, wherein the image forming stations PY, PM, PC, PK are disposed on an upward surface of an intermediary transfer belt 31. An intermediary transfer unit 30 as an example of the transfer belt unit and a process cartridge 10 as an example of the photosensitive member unit are incorporated detachably into a housing 101 of the image forming apparatus 100.

In the image forming station PY, a yellow toner image is formed on a photosensitive drum 1Y, which is transferred (primary transfer) onto the intermediary transfer belt 31. In the image forming station PM, a magenta toner image is formed on a photosensitive drum 1M, which is superimposedly transferred (primary transfer) onto the yellow toner image on the intermediary transfer belt 31. In the image forming stations PC, PK, a cyan toner image, a black toner image is formed on photosensitive drums 1C, 1K, which is sequentially similarly transferred (primary transfer) onto the intermediary transfer belt 31.

The four color toner images carried on the intermediary transfer belt 31 are fed to a secondary transfer portion T2, and are superimposedly transferred (secondary transfer) onto the intermediary transfer belt 31 all together onto a recording material P nipped and fed through the secondary transfer portion T2. The recording material P supplied from a recording material cassette 10 is separated one by one by a separation roller 11, and is fed to a registration roller 12. The recording material P is temporally stopped by the registration roller 12, and is fed timed with the toner image on the intermediary transfer belt 31 to the secondary transfer portion T2. The recording material P which has received the toner image by the secondary transfer portion T2 is heated and pressed by a fixing device 15, by which the toner image is fixed on a surface thereof, and thereafter, it is discharged to an outside.

The image forming stations PY, PM, PC, PK have substantially the same structures with the exception that the toner colors of the used developing devices 4Y, 4M, 4C, 4K s are yellow, magenta, cyan, and black, respectively. An image forming station PK of the black will be described, as an exemplary image forming station and as for the other image forming stations PY, PM, PC, PK, the following description will apply by changing the suffixes to Y, M or C.

The image forming station PK includes a corona charger 2K, an exposure device 3K, a developing device 4K, and a primary transfer roller 5K around a photosensitive drum 1K. The photosensitive drum 1K comprises a metal cylinder on which a photosensitive layer which has the negative charging property is formed, and is rotated in the direction indicated by the arrow at a predetermined process speed.

The corona charger 2K applies charged particles produced by corona discharge to the photosensitive drum 1K to charge the surface of the photosensitive drum 1K to the uniform negative potential. The exposure device 3K deflects a laser beam modulated by the scanning line image data which are indicative of image data ON-OFF by a polygonal mirror to write the image on an electrostatic image on the charged surface of the photosensitive drum 1K. The developing device 4K rubs the photosensitive drum 1K with the charged two-component developer carried on a developing sleeve 4*s*, and an oscillation voltage in the form of an AC voltage biased by a negative DC voltage is applied to the developing sleeve 4*s* to reversely develop the electrostatic image on the photosensitive drum 1K.

The primary transfer roller 5K presses an internal surface of the intermediary transfer belt 31 to form a primary transfer portion TK between the photosensitive drum 1K and the intermediary transfer belt 31. By applying the positive DC voltage to the primary transfer roller 5K, the toner image carried on the photosensitive drum 1K is transferred (primary transfer) onto the intermediary transfer belt 31.

The secondary transfer roller 13 is contacted to the intermediary transfer belt 31 supported by an opposing roller 14 to form the secondary transfer portion T2. In nipping and feeding the recording material P with the toner image of the intermediary transfer belt 31, the positive potential is applied to the secondary transfer roller 13 so that the toner image carried on the intermediary transfer belt 31 is transferred (secondary transfer) onto the recording material P.

The intermediary transfer belt 31 is trained around a tension roller 33, a driving roller 32, and the opposing roller 14, and it is driven by the driving roller 32 to rotate at the predetermined process speed in a direction of the arrow R2.

Referring to FIG. 1, as shown in FIG. 2, the intermediary transfer unit 30 includes a driving motor which rotates the intermediary transfer belt 31, a steering controlling motor which positions the intermediary transfer belt 31 dynamically in the widthwise direction integrally. In the case where the wearing, damage, and the damage of the driving motor of the intermediary transfer belt 31 *s* and so on occur, a user can exchange the intermediary transfer unit 30 with the new one easily. When a manual lever 68 is rotated, a spacing mechanism 20 shown in FIG. 1 operates, so that n the intermediary transfer belt 31 spaces from the photosensitive drums 1Y, 1M, 10, 1K.

As will be understood from FIGS. 1 and 3, the process cartridge 10 is an exchange unit which has the photosensitive drum 1K unintegral with the developing device 4K. The process cartridge 10 is guided in engagement holes 57, 58 with a drum shaft 55 provided in a housing (101) side, and it is taken out to the front side and is exchanged.

The process cartridge 10 exposes the photosensitive drum 1K in the oblique upper portion which opposes to the developing device 4K and the lower portion opposed to the intermediary transfer belt 31. The process cartridge 10 is provided with a groove 81 as an example of a guiding portion which meets in the longitudinal direction of the process cartridge 10 and is extended continuously in a position remote from the drum shaft 55 in a rotational direction of the intermediary transfer belt 31. The groove 81 is an example of the guiding portion formed on a side surface of photosensitive member unit (10) which stands up relative to the surface of the transfer belt member (31).

A spacing mechanism 23 makes the secondary transfer roller 13 rises and lowers to contact and space the secondary transfer portion T2. The secondary transfer roller 13 is spaced from the intermediary transfer belt 31 other than image formation o'clock, in order to avoid a deformation of the secondary transfer roller 13. By this, in drawing the intermediary transfer unit 30 out to the front side, the unnecessary rubbing between the secondary transfer roller 13 and the intermediary transfer belt 31 is avoided.

The spacing mechanism 20 lowers the intermediary transfer belt 31 to space it from the photosensitive drums 1Y, 1M, 1C, 1K. By this, in drawing the intermediary transfer unit 30 out to the front side, the unnecessary rubbing between the photosensitive drums 1Y, 1M, 1C, 1K and the intermediary transfer belt 31 is avoided.

<Drawer Structure of Intermediary Transfer Unit>

Figure 4:
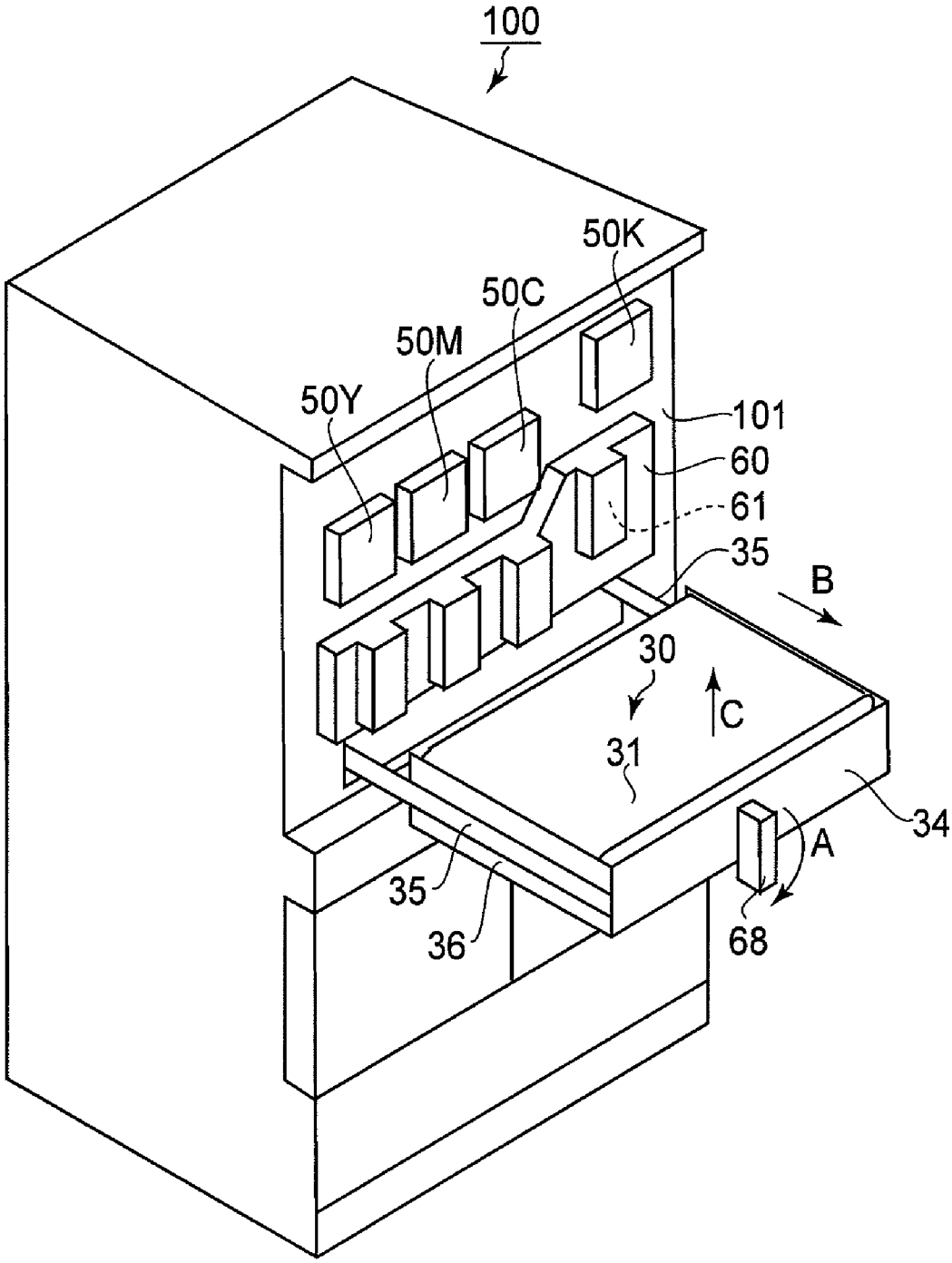
FIG. 4 is an illustration of structures of the drawer for the intermediary transfer unit.
Figure 5:
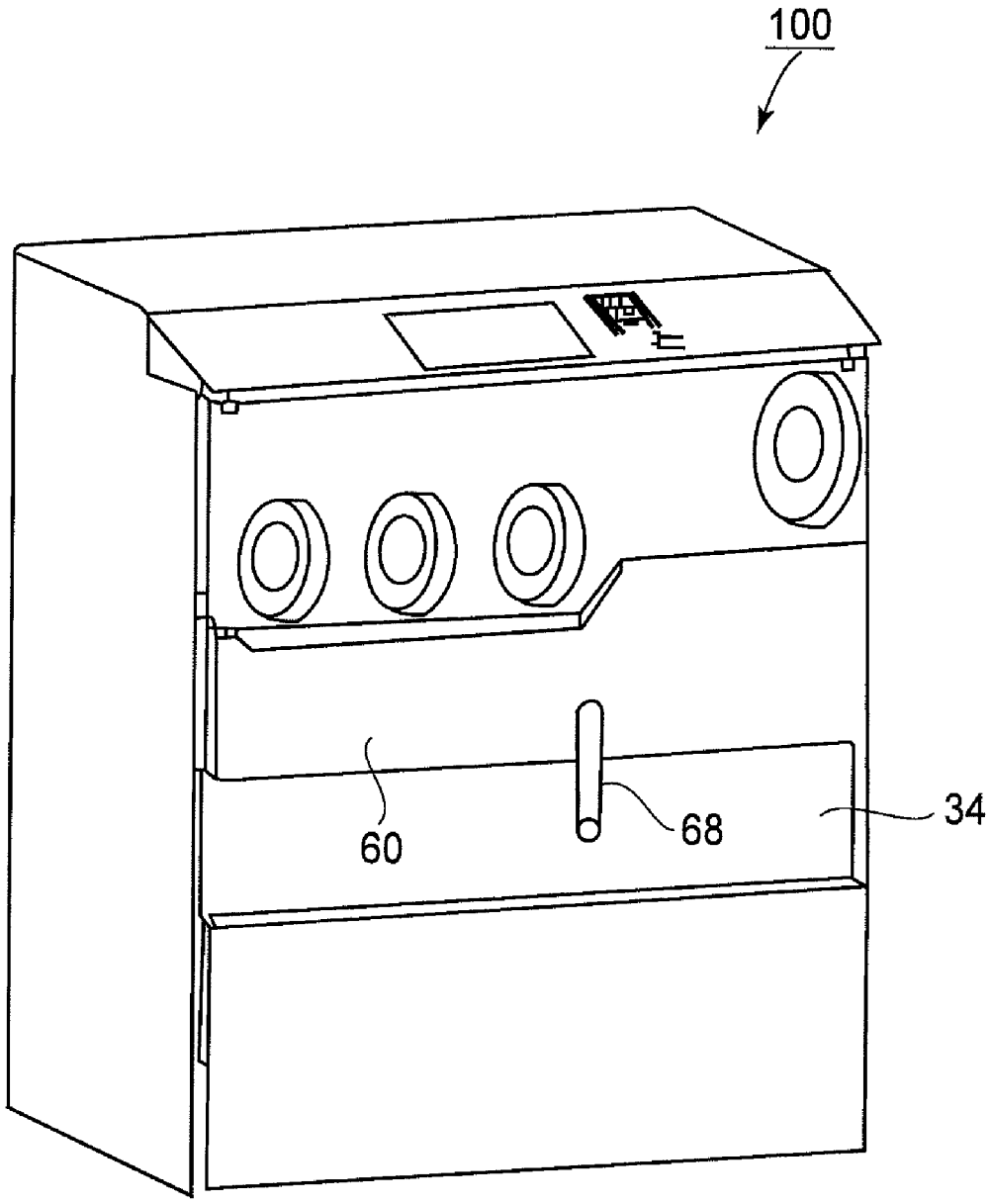
FIG. 5 is an illustration of the state that the intermediary transfer unit is pulled.
Figure 6:
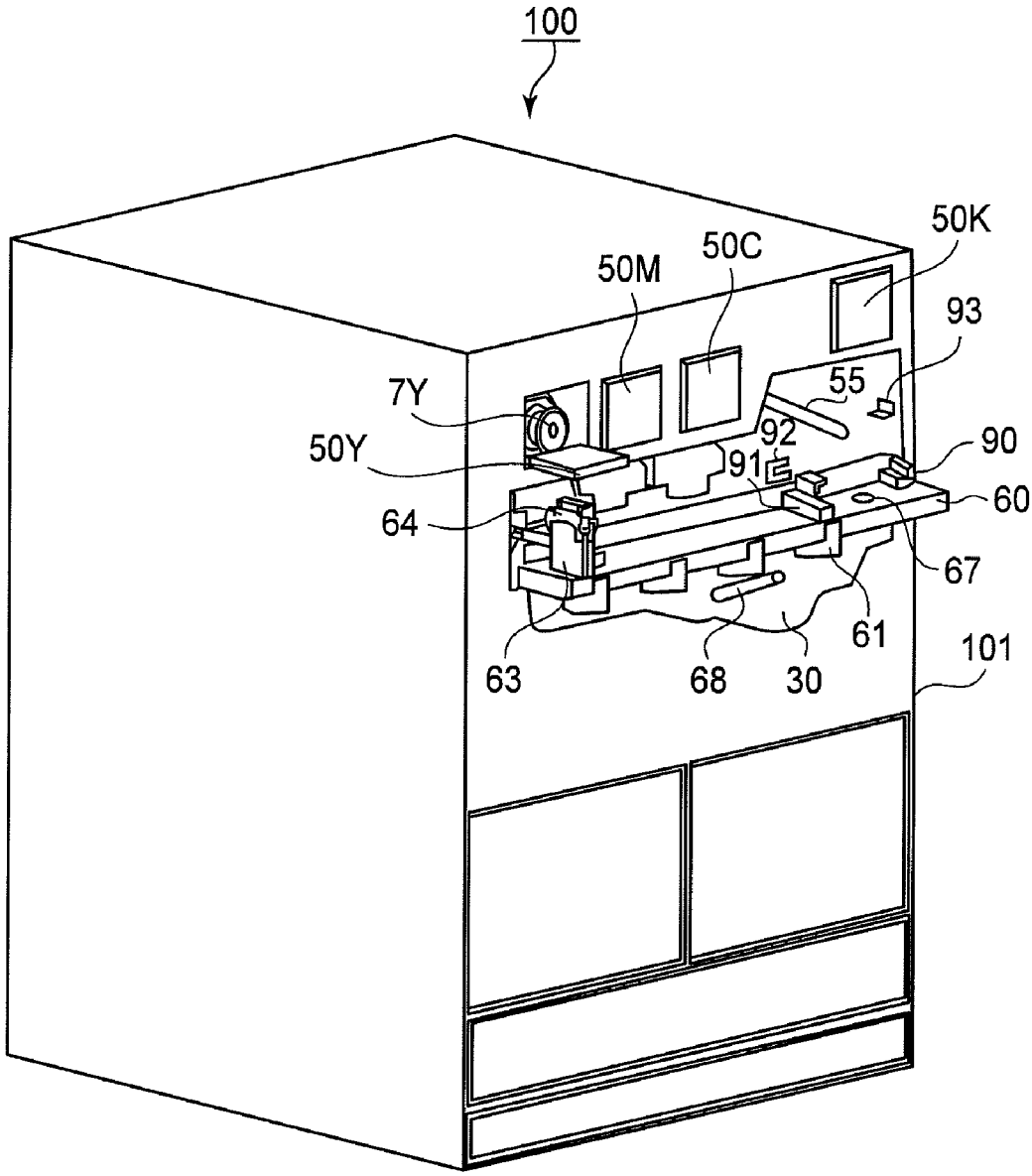
FIG. 6 is an illustration of an opening and closing structure for a composite machine unit.
Figure 7:
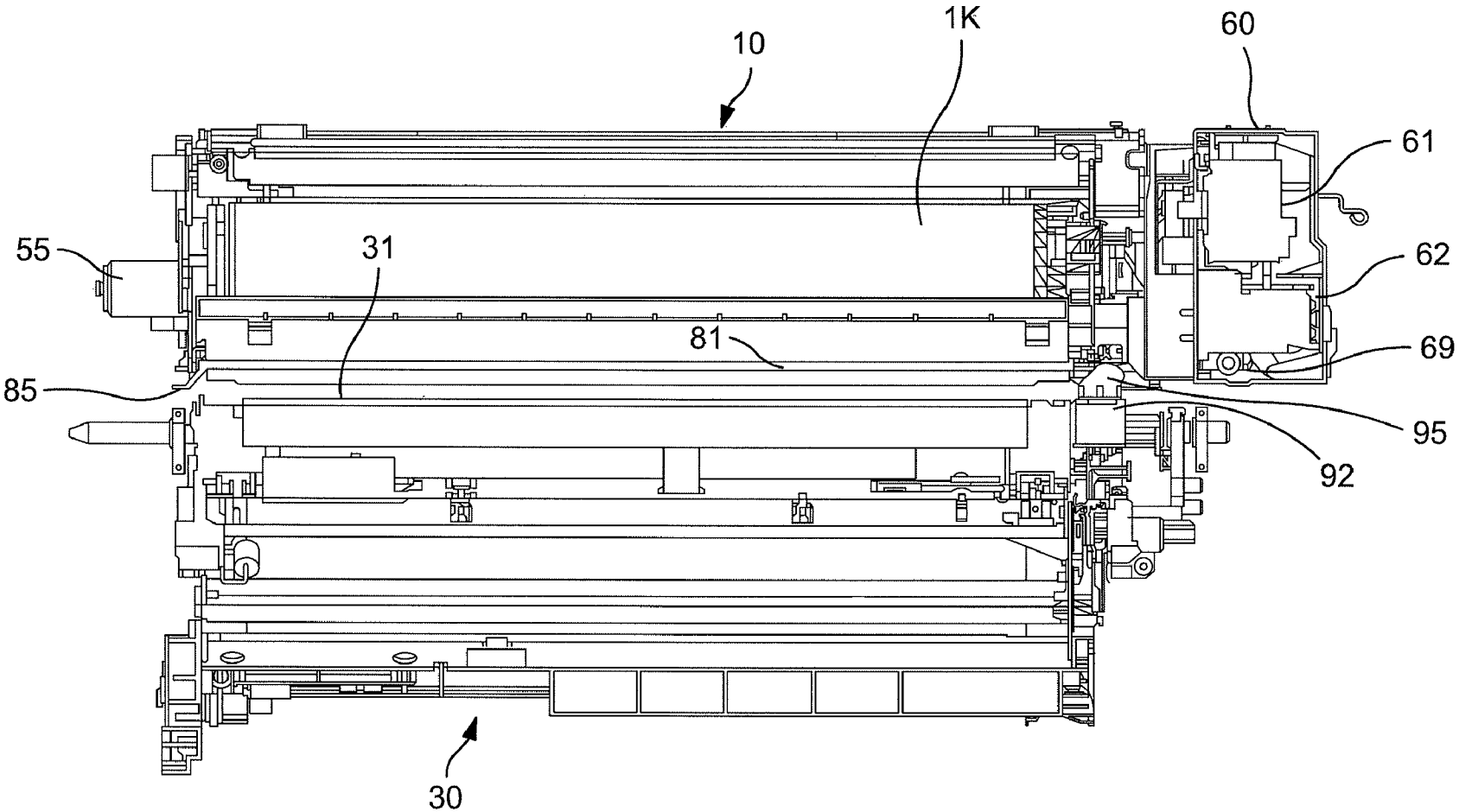
FIG. 7 is an illustration in the state that the intermediary transfer unit and the process cartridge are mounted.

FIG. 4 is an illustration of the drawer structure of the intermediary transfer unit. FIG. 5 is an illustration of the state of pulling the intermediary transfer unit. FIG. 6 is an illustration of the opening and closing structure of the composite machine unit. FIG. 7 is an illustration of the state that the intermediary transfer unit and the process cartridge are mounted.

Referring to FIG. 1, as shown in FIG. 4, the intermediary transfer unit 30 is held detachably to a frame 36 horizontally drawn by the pair of slide rails 35 to the front side. After the frame 36 is drawn in a direction of the arrow B from the housing 101, the intermediary transfer unit 30 is taken out in a direction of the arrow C. Prior to the drawing of the frame 36, the user manually moves the manual lever 68 provided on a front side plate 34 in a direction of an arrow A. By this, an eccentric cam 22 shown in FIG. 1 rotates to operate the spacing mechanism 20, and the intermediary transfer belt 31 spaces from the photosensitive drums 1Y, 1M, 1C, 1K.

A front side of the housing 101 is provided with the exchange doors 50Y, 50M, 50C, 50K for the color toner bottles 7Y, 7M, 7C, 7K, respectively, which are pulled down in forward direction and opened. The exchange doors 50Y, 50M, 50C, 50K are openable and closable independently from each other, and are opened and closed in the case of the exchange of the toner bottles 7Y, 7M, 7C, 7K, respectively.

The front side of the housing 101 is provided with an openable and closable door unit 60 openable and closable relative to the housing 101. In order to open the openable and closable door unit 60, the manual lever 68 is rotated, and the spacing mechanism 20 shown in FIG. 1 operates to space the intermediary transfer belt 31 from the photosensitive drums 1Y, 1M, 1C, 1K. As shown in FIG. 5, the manual lever 68 is maintained in the position which prevents the operation of pulling down, in forward direction, the openable and closable door unit 60 in a normal operational status.

Referring to FIG. 1, a composite machine unit 60 is provided with a bearing mechanism for the shaft member (55) engaged with the photosensitive member (1K) by moving photosensitive member unit (10) along a shaft member (55), as shown in FIG. 6. In the state that, the composite machine unit 60 is drawn out along the drum shaft 55 to the front side, and the drum shaft 55 is dismounted from the engagement hole 67, the openable lid unit 60 is openable from the housing 101 by tilting to a front side.

An upper surface of the tilted composite machine unit 60 is provided with the positioning members (90, 91) for supporting the process cartridge 10 movably along the drum, shaft 55 in the state that the center of the photosensitive drum 1K is positioned by the drum shaft 55. When the process cartridge 10 is exchanged, the guiding members 90, 91 correct an attitude of the process cartridge 10 to prevent the contact of the process cartridge 10 to the intermediary transfer belt 31 of the intermediary transfer unit 30. The guiding members 90, 91 position the drum shaft 55 to the engagement hole 58 of the photosensitive drum 1K of the process cartridge 10 to make the mounting and demounting of the process cartridge 10 easy.

The developing device 4K receives the driving forces in the respective ends in the longitudinal direction. As a driving source therefor, as shown in FIG. 7, a motor 61 is provided on the openable and closable door unit 60. A driving gear unit 62 for transmitting the driving force to the developing device 4K from the motor 61 is also provided on the openable and closable door unit 60. The openable and closable door unit 60 is tilted about a rotational shaft 69 to the front side.

as shown in FIG. 6, for the electric power supply to the motor 61, the openable and closable door unit 60 is provided with a drawer 63 as an electrical contact portion. The electric power is supplied to the motor 61 by an electric wire bundle (unshown) extending from the drawer 63. The drawer 63 is electrically connected with the electrical contact portion (unshown) provided in the housing (101) side by closing the openable and closable door unit 60. The drawer 63 is provided with a drawer shutter 64 to cover the contact portion.

<Mounting and Demounting Structure of Process Cartridge>

Figure 8:
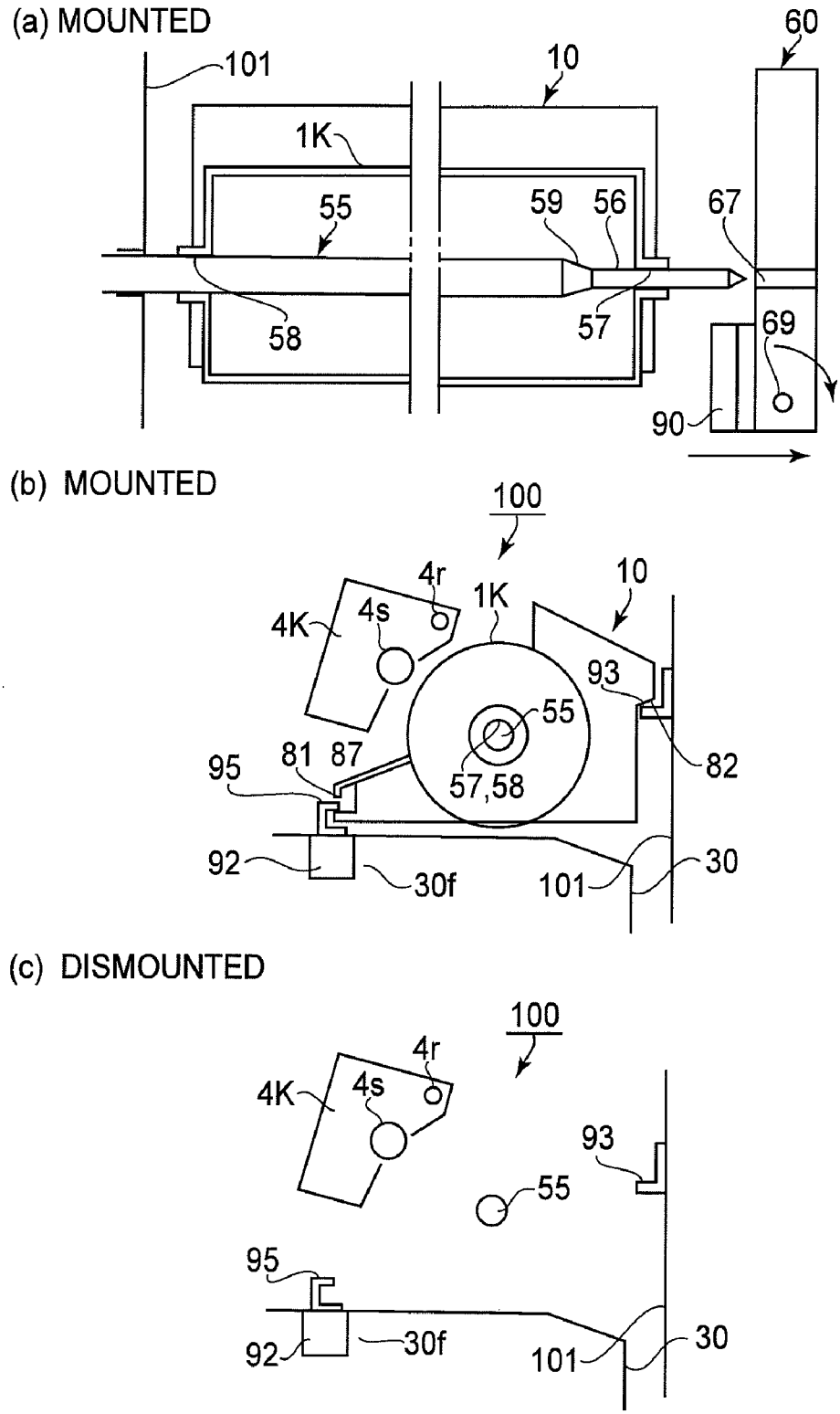
FIG. 8 is an illustration of a mounted state of the process cartridge.

FIG. 8 is an illustration of the mounted state of the process cartridge. as shown in (a) of FIG. 8, the operation of inserting the process cartridge 10 into the housing 101 is carried out, while the drum shaft 55 disposed at the housing 101 inserts in the center of the photosensitive drum 1K which is integral with the process cartridge 10.

More particularly, a leading end 56 of the drum shaft 55 penetrates the engagement hole 58 of the photosensitive drum 1K. Thereafter, the leading end 56 of the drum shaft 55 engages with the engagement hole 67 provided on the openable and closable door unit 60.

A tolerance in the fitting of the drum shaft 55 relative to the engagement holes 57, 58 of the photosensitive drum 1K is, such that it is press-fitting in several millimeters in the last part of a mounting operation, and loose-fitting before the last part to permit the smooth movement of the process cartridge 10. The photosensitive drum 1K and the drum shaft 55 engage with each other at the front side and the rear side of the main assembly, and a main assembly rear side engagement hole 58 is larger by several millimeters than by a front side engagement hole 57. For this reason, since the engagement hole at the time of an insertion 57 is larger by several millimeters than by the drum shaft 55, the insertion is easy.

A taper 59 is provided at the position near to a leading end of the drum shaft 55 to increase the diameter, by which, the operativity after the insertion is improved. A leading end 56 of the drum shaft 55 becomes thin, such that it is smaller than a rear side engagement hole 58 between the photosensitive drum 1K and the drum shaft 55, by which, the operating force when the openable and closable door unit 60 is inserted into the housing 101 is reduced.

The drum shaft 55 is through the center of the photosensitive drum 1K, and therefore, an eccentric rotation of the photosensitive drum 1K and the deflection of the shaft are reduced. However, it is preferable that the process cartridge 10 is positioned in the state of being hung by the drum shaft 55, so that a bending load may not be imparted to the drum shaft 55 in the mounted state, and for this reason, in the position other than the engagement holes 57, 58, it is elastically supported with margin.

The operation of mounting and demounting the process cartridge 10 from the housing 101 and exchanging with a new one is as follows.

(1) As shown in FIG. 5, the manual lever 68 is tilted to move the intermediary transfer belt 31 of the intermediary transfer unit 30 downwardly. When the manual lever 68 is not opened, the openable and closable door unit 60 cannot be pulled out to a front side.

(2) As shown in FIG. 6, the openable and closable door unit 60 is once drawn to the housing 101 front side, and the drum shaft 55 is taken out of the engagement hole 67, and thereafter, it is tilted to the front side to rotate downwardly. The openable and closable door unit 60 is lowered, and the guiding members 90, 91 for drawing the process cartridge 10 from the housing 101 appear.

(3) The process cartridge 10 is drawn out while being guided by the drum shafts 55 and the guiding members 90, 91.

(4) A new process cartridge to replace 10 is inserted into the housing 101 from the state shown in (c) of FIG. 8. In the insertion, the process cartridge 10 is placed on the guiding members 90, 91, and the drum shaft 55 is positioned to the center of the photosensitive drum 1K.

(5) A new process cartridge 10 is pushed in, while being guided by the guiding members 90, 91.

<Guiding Mechanism>

Figure 9:
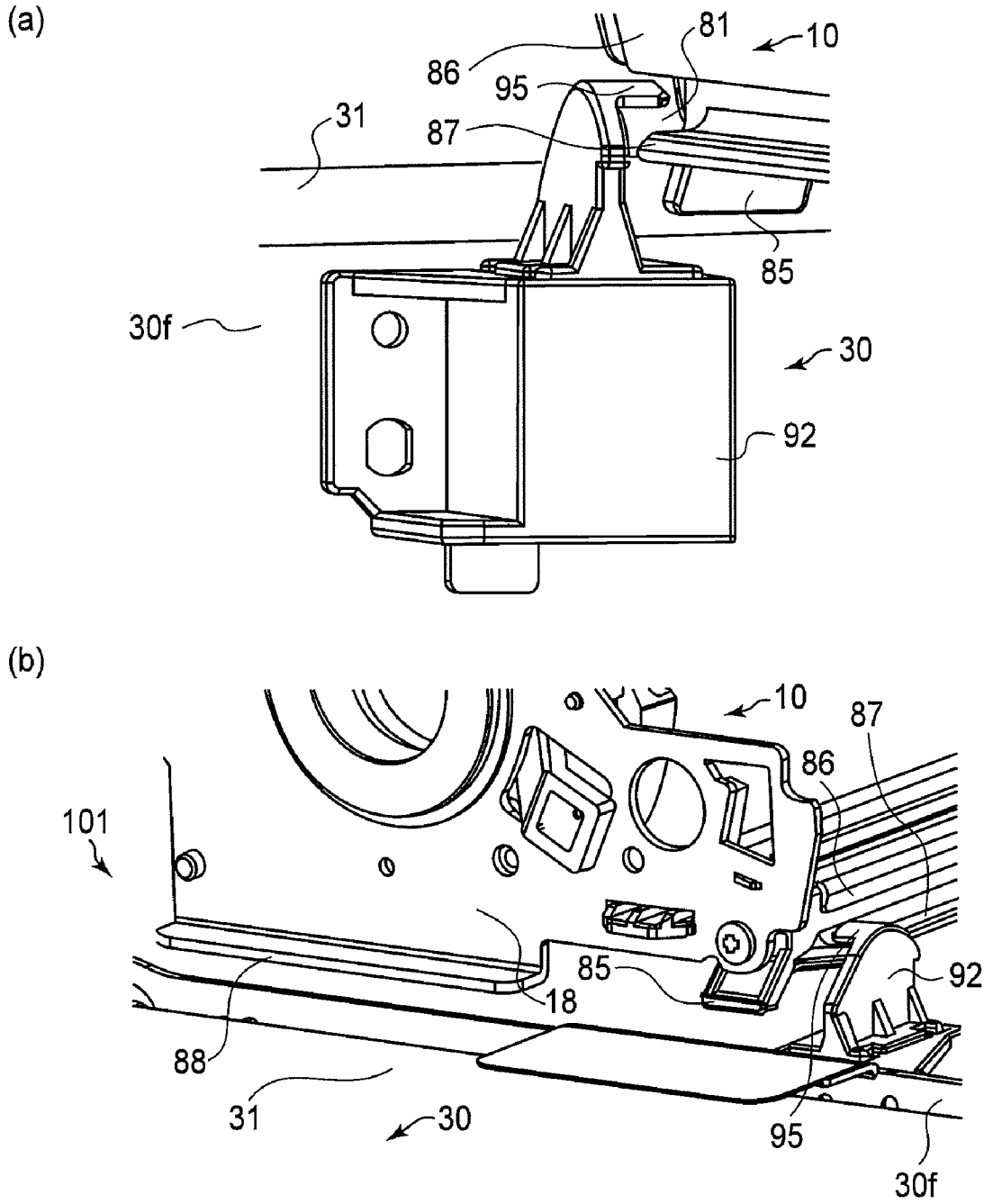
FIG. 9 is an illustration of a mounting process of the process cartridge.
Figure 10:
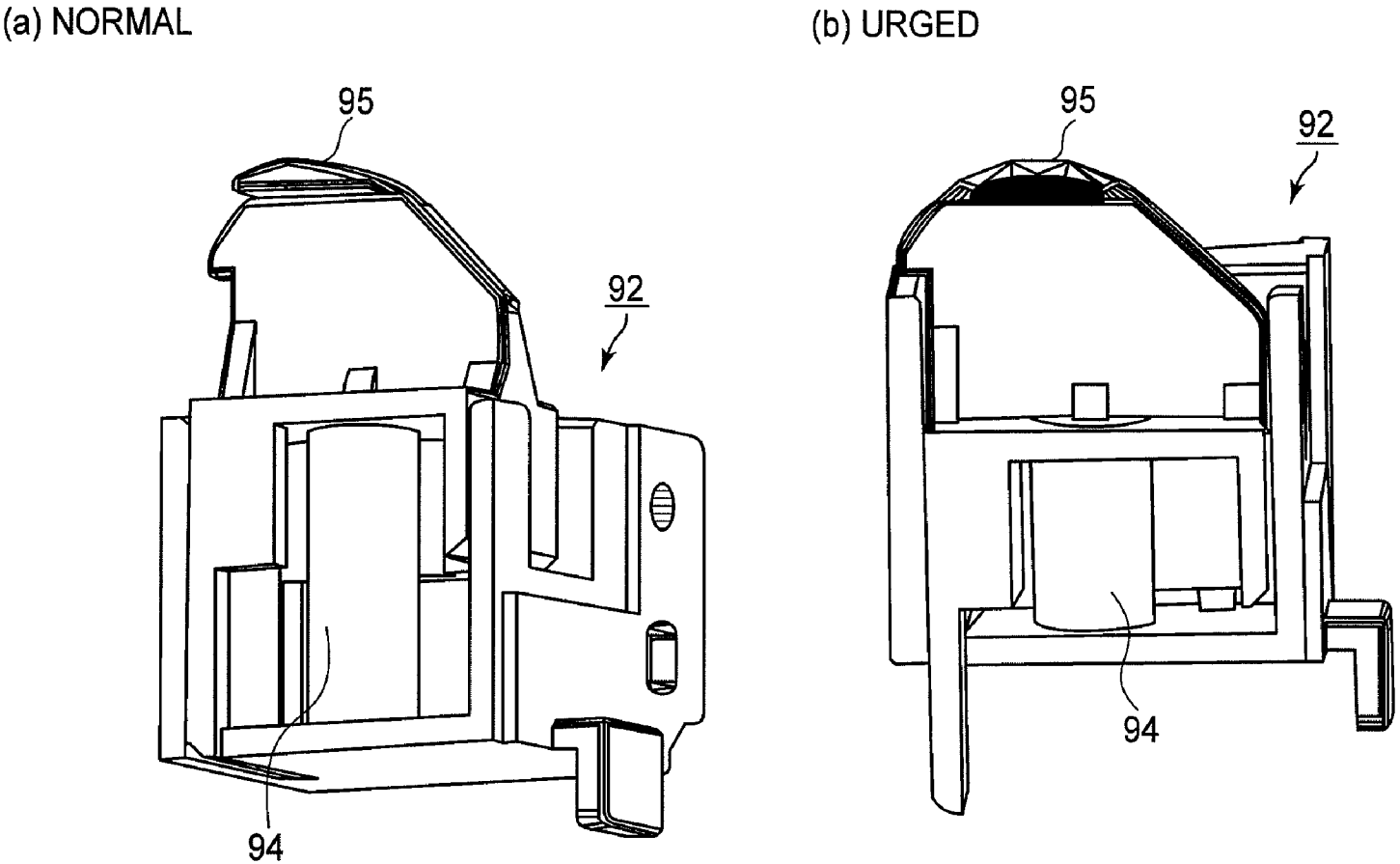
FIG. 10 is an illustration of the operation of a guiding mechanism.

FIG. 9 is an illustration of the mounting process of the process cartridge. FIG. 10 is an illustration of the operation of the guiding mechanism. In FIG. 9, (a) is an enlarged view of the guiding mechanism, as seen in an inserting direction, and (b) is an enlarged view of the guiding mechanism, as seen from a rear side. In FIG. 10, (a) shows a normal state projected, and the (b) shows a retracted state.

As shown in (a) of FIG. 8, in an initial stage in the insertion of the new process cartridge 10, the engagement length between the photosensitive drum 1K and the drum shaft 55 is short, and therefore, the attitude of the process cartridge 10 is unstable. as shown in FIG. 3, a leading end of a process cartridge 88 is provided with the projected portions 85, 88, and therefore, when the process cartridge 88 is obliquely downwardly inserted, the projected portions 85, 88 may be contacted to the intermediary transfer belt 31.

During the insertion, even if the process cartridge 88 is rotated about the drum shaft 55, (rotation around the shaft member), the projected portions 85, 88 may contact to the intermediary transfer belt 31.

In view of this, guiding mechanisms 92, 93 are provided, so that n if the attitude in an axial direction and the rotational direction is not right the operator is made to be noticed by the limitation, simultaneously, the process cartridge 10 is guided to the right position.

As shown in (b) of FIG. 8, the guiding mechanism 92 is fixed to a frame (front side plate) 30*f* of the intermediary transfer unit 30. The guiding mechanism 92 is provided with a rotation regulating member 95 urged upwardly by means of a spring with the limitation of the upward movement. When, the process cartridge 10 is engaged around the drum shaft 55 and is moved along the drum shaft 55, the guiding mechanism 92 restrains a groove (guiding portion) 81 to restrict the rotation of the process cartridge 10 around the drum shaft 55.

The guiding mechanism 92 prevents the contact to the intermediary transfer belt 31 at the time of the insertion, into the housing 101, of the process cartridge 10. The guiding mechanism 92 passes without contact to the groove 81 of the process cartridge 10, when the process cartridge 10 advances in the right attitude. However, when the process cartridge 10 rotates around the drum shaft 55 beyond tolerance, the guiding mechanism 92 is contacted to the groove 81 of the process cartridge 10 to restrict the rotation.

The internal surface of the housing 101 is provided with a guiding mechanism 93. At the time of the process cartridge 10 moving along the drum shaft 55, if it rotates beyond tolerance around the drum shaft 55, the guiding mechanism 93 is contacted to a projection 82 to restrict the rotation of the process cartridge 10.

At the time of the insertion start of the process cartridge 10, when the attitude of the process cartridge 10 oblique, to such an extent that the rotation regulating member 95 does not enter the groove 81, the projection 82 of the process cartridge 10 abuts to the guiding mechanism 93. For this reason, the operator notices the obliqueness of the process cartridge 10 to prompt the operator to the correction.

While the process cartridge 10 supported by the drum shaft 55 is regulated in rotation at two places on the outer periphery by the guiding mechanisms 92, 93, it is inserted into the housing 101. As a result, the process cartridge 10 can be inserted into the housing 101 with the stabilized attitude.

At the time of the mounting and dismounting operation of the process cartridge 10, the contact of the process cartridge 10 relative to the guiding mechanisms 92, 93 in the case of the movement along the drum shaft 55 is also light, so that n the bending load is not imparted to the drum shaft 55 substantially.

More particularly, when the process cartridge 10 is inserted into the housing 101 with the positioning with the guiding members 90 and 91 shown in FIG. 6, there is a slight interval between the rotation regulating member 95 of the guiding mechanism 92 and the side surface of the groove 81 of the process cartridge 10. The rotation regulating member 95 is held in a middle position with respect to a groove width direction of the groove 81 extended in the longitudinal direction of the process cartridge 10, so that n it can pass without contact to the groove 81. The projection 82 formed on the side surface of the process cartridge 10 of the side opposite from the guiding mechanism 92 is disposed, such that it can pass without contact to the guiding mechanism 93 similarly.

As shown in (b) of FIG. 9, when the process cartridge 10 begins to insert into the housing 101, the intermediary transfer belt 31 and the projected portions 85, 88 which are in the neighborhood of the groove 81 of the process cartridge 10 approach dramatically to each other. Also in an ideal insertion state, they approach closely to each other, and therefore, if the attitude of the process cartridge 10 may change easily, the intermediary transfer belt 31 and the projected portions 85, 88 may be contacted to each other. When the projected portions 85, 88 of a metal plate contacts, the intermediary transfer belt 31 is damaged, and an image may receive the adverse affect.

Here, when the process cartridge 10 inclines in the counterclockwise direction about the drum shaft 55, an upper side 86 and an upper side surface of the rotation regulating member 95 of the guiding mechanism 92 of the groove 81 contact to each other as shown in (a) of FIG. 9. As shown in (a) of FIG. 10, the rotation regulating member 95 of the guiding mechanism 92 is normally urged upwardly by an elastic force of a coil spring 94, and as shown in (b) of FIG. 10, when an urging force is received downward, it is moved downwardly.

In the inserting process of the process cartridge 10, when the rotation regulating member 95 is pressed downward by the groove 81, the clockwise rotational force about the drum shaft 55 is imparted to the process cartridge 10 by the elastic force of the coil spring 94. By this, the process cartridge 10 tends to return to the ideal attitude.

On the contrary, when the process cartridge 10 inclines clockwisely about the drum shaft 55, a lower side 87 of a groove 61 and a lower surface of the rotation regulating member 95 of the guiding mechanism 92 contact to each other. Then, the counterclockwise rotational force about the drum shaft 55 is imparted to the process cartridge 10 toward the ideal attitude.

As will be understood from the foregoing description, in this embodiment, the intermediary transfer unit 30 is provided with the guiding mechanism 92 for regulating the attitude of the process cartridge 10 in order not to damage the intermediary transfer belt 31 or the photosensitive drum 1K. By this, a rail for supporting the photosensitive drum 1K across the intermediary transfer belt 31 is unnecessary, and therefore a downsizing and a cost reduction of a main assembly is accomplished. The reduction of the image quality which results from the toner which piles up on the rail and which falls on the intermediary transfer belt 31 is also eliminated.

As shown in FIG. 3, the groove 81 is extended over the overall length, with respect to the longitudinal direction, of the process cartridge 10, but in the mounted state shown in FIG. 7, the rotation regulating member 95 is in the outside of the overall length of the groove 81. For this reason, when the intermediary transfer unit 30 is roughly returned, the guiding mechanism 92 of the intermediary transfer unit 30 does not collide against the process cartridge 10.

When the intermediary transfer unit 30 is drawn from the housing 101, the process cartridge 10 lowers from the right position. Even in this case, because the guiding mechanism 92 is disposed in the outside of an end of the intermediary transfer belt 31, and the rotation regulating member 95 is placed in the outside of the groove 81, and the process cartridge 10 lowers together, and therefore the drum shaft 55 does not receive the unnecessary force. As described in the foregoing, the unnecessary force is not applied to the drum shaft 55, by which, a load fluctuation of the drum shaft 55, the eccentric rotation, the whirling of the rotation are avoided, and the peripheral speed of the photosensitive drum 1K is stabilized, and the enlargement of the deformation of the toner image and the image registration error can be suppressed.

The rotation regulating member 95 is urged upwardly by the elastic force of the coil spring 94, and therefore, when the process cartridge 10 is pressed from the top, it retracts smoothly, and therefore, the frictional force does not increase. For this reason, it can be avoided that the process cartridge 10 collides against the abutment bottom surface of the housing 101 by the operator pushing the process cartridge 10 by the strong force, when the frictional force increases, and therefore a load is not imparted to the drum shaft 55.

Since the rotation regulating member 95 produces the force of raising the process cartridge 10 by the elastic force of the coil spring 94, the contact between the intermediary transfer belt 31 and the process cartridge 10 is avoided. Simultaneously, the contact between the photosensitive drum 1K and the intermediary transfer unit 30 is also avoidable. There is a mechanism for changing the attitude of the photosensitive member unit to the ideal attitude adjacent to the transfer belt member with which the damage by the collision is not preferable, and therefore, the distance between the members which have the possibility of the collision can stably be assured.

The rotation regulating member 95 is movable downwardly to the frame height of the intermediary transfer unit 30, and therefore, in drawing the intermediary transfer unit 30 out to the front, as shown in Figure, the rotation regulating member 95 is pushed in downwardly not to interfere with the drawer.

Since the rotation regulating member (95) is provided not on the housing (101) but on the transfer belt unit (30), the attitude of photosensitive member unit (10) can be regulated at the position close to the transfer belt member (31). A rotation regulating member (95) is mounted to the transfer belt unit (30) supporting the transfer belt member, by which, the positional accuracy of the transfer portion (TK) formed by the photosensitive member (1K) and the transfer belt member (31) can be enhanced. A relative positional relation of the photosensitive member unit and the transfer belt unit between which the contact is unpreferable is directly set by the rotation regulating member, and therefore, the variation in gap therebetween is reduced, as compared with the case in which they are indirectly positioned through the housing.

For this reason, a minimum necessary clearance can be set in the mechanism for spacing the transfer belt member (31) from the photosensitive member (1K). In the case that, the transfer belt unit (30) is drawn, and is not in the housing, the photosensitive member unit (30) can be mounted and demounted without the unnecessary confinement by the rotation regulating member (95).

In this embodiment, the openable and closable door unit 60 is drawn once to the front side, and then are pulled down, and therefore, it results that the guiding members 90, 91 regulate the attitude of the process cartridge 10 at the position quite away from the intermediary transfer belt 31 quite the front side. For this reason, the slight inclination and the rotation by the hand causes the large movement, rising and lowering of the leading end of the process cartridge 10 on the intermediary transfer belt 31.

However, the rotation regulating member 95 regulates the position of the leading end of the process cartridge 10 at the position very close to the intermediary transfer belt 31, and therefore, the contact to the intermediary transfer belt 31 of the leading end of the process cartridge 10 and the application of the large force to the drum shaft 55 are substantially avoided assuredly.

According to the structure according to this embodiment shown in FIG. 1, the units can be exchanged for respective lifetimes. In other words, the developing device 4K and the process cartridge 10 which supports the photosensitive drum 1K can be exchanged individually.

In the case where the process cartridge 10 is exchanged leaving the developing device 4K, the important photosensitive drum 1K is exposed to increase the possibility of the damage. For this reason, the regulation of the attitude for extraction and insertion of the process cartridge 10 requires highly advanced regulation. According to the structure according to this embodiment, the level of the center of the photosensitive drum 1K is precisely determined by the drum shaft 55, and therefore, the possibility of the interference, with respect to the surrounding constituent members, of the photosensitive drum 1K is low.

However, the drum shaft 55 rotationally driven by the housing (101) side penetrates the photosensitive drum 1K, and therefore, the attitude of the process cartridge 10 may rotate about the drum shaft 55. According to the structure of this embodiment, the groove (81) formed in the side surface of the photosensitive member unit is restrained by the rotation regulating member (95) provided on the transfer belt unit (30), and therefore, the rotation, in either directions, of the photosensitive member unit (30) is limited within the tolerance with which the contact can be avoided. In the image forming apparatus according to this embodiment, in the process in which the photosensitive member unit is moved along the shaft member, the attitude of the photosensitive member unit can be visually confirmed because of the positional relation between the guiding portion of the photosensitive member unit and the rotation regulating member of the transfer belt unit. For this reason, the rotation, around the shaft member, of the photosensitive member unit is restricted mentally and the straight insertion of the transfer belt unit can be carried out onto the shaft member. The guide surface is mechanically restrained by the rotation regulating member, by which, also physically, the rotation, around the shaft member, of the photosensitive member unit is restricted, and therefore, even in the case where the photosensitive member unit is rotated around the shaft member, the contact between the photosensitive member unit and the transfer belt member is avoidable.

Therefore, the photosensitive member unit is smoothly inserted in the stabilized attitude without applying the load to the shaft member to suppress the contact to the transfer belt member due to the rotation of the photosensitive member unit in the inserting process.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 185132/2009 filed Aug. 7, 2009 which is hereby incorporated by reference.

What is claimed is:

1. An image forming apparatus comprising:

a housing;

a photosensitive member unit detachably mountable relative to said housing and which includes a photosensitive member;

a transfer belt unit detachably mountable relative to said housing which includes a transfer belt member and a spacing mechanism for spacing said transfer belt member from said photosensitive member;

a shaft member, provided in said housing, for supporting said photosensitive member;

a guiding portion, provided on said photosensitive member unit, for guiding mounting, to said housing, of said photosensitive member unit; and a rotation regulating member, provided on said transfer belt unit, for regulating a movement of said guiding portion, in the a rotational direction, of said photosensitive member at the time of the mounting of said photosensitive unit to said housing.

2. An apparatus according to claim 1, wherein said guiding portion is a groove formed in a side surface of said photosensitive member unit, and said rotation regulating member is provided with a projection engageable with said groove.

3. An apparatus according to claim 1, wherein said guiding portion is in a position where it is not regulated by said rotation regulating member, when said photosensitive member unit is mounted to a position for forming the image.

4. An apparatus according to claim 1, wherein said rotation regulating member is retractable from a position for regulating the movement of said guiding portion in drawing said transfer belt unit.

5. An apparatus according to claim 1, wherein said rotation regulating member is disposed upstream of the photosensitive member mounted to an image forming position with respect to an inserting direction of the photosensitive member unit.

6. An apparatus according to claim 1, wherein said photosensitive member unit is detachably mountable in a state that said transfer belt unit is mounted to said housing.

7. An apparatus according to claim 1, wherein said transfer belt unit is detachably mountable in a state that said photosensitive member unit is mounted to said housing.

8. An apparatus according to claim 1, further comprising a second photosensitive member unit mountable to said housing and including a second photosensitive member, wherein a diameter of said photosensitive member is larger than a diameter of said second photosensitive member.

9. An apparatus according to claim 7, wherein said rotation regulating portion is disposed between said photosensitive member and said second photosensitive member.

10. An apparatus according to claim 1, wherein said apparatus includes a plurality of such photosensitive member units, wherein a diameter of said photosensitive member mounted to said housing said rotation regulating member is the largest.

* * * * *